US009863741B2

(12) United States Patent
Tresserras Torre et al.

(10) Patent No.: US 9,863,741 B2
(45) Date of Patent: Jan. 9, 2018

(54) ACCESSORY FOR INSTALLING, POSITIONING AND ATTACHING A TELESCOPIC SIGHT OR ANY OTHER AIMING ACCESSORY ON A SPORTING GUN OR FIREARM

(71) Applicant: Gamo Outdoor, S.L., Sant Boi de Llobregat (ES)

(72) Inventors: Victor Tresserras Torre, Sant Boi de Llobregat (ES); Julian Arnedo Vera, Sant Boi de Llobregat (ES)

(73) Assignee: GAMO OUTDOOR, S.L. (ES)

( * ) Notice: Subject to any disclaimer, the term of this patent is extended or adjusted under 35 U.S.C. 154(b) by 0 days.

(21) Appl. No.: 15/510,570

(22) PCT Filed: Sep. 12, 2014

(86) PCT No.: PCT/ES2014/070698
§ 371 (c)(1),
(2) Date: Mar. 10, 2017

(87) PCT Pub. No.: WO2016/038229
PCT Pub. Date: Mar. 17, 2016

(65) Prior Publication Data
US 2017/0191801 A1 Jul. 6, 2017

(51) Int. Cl.
*F41G 11/00* (2006.01)

(52) U.S. Cl.
CPC ..... *F41G 11/002* (2013.01); *F41G 11/003* (2013.01); *F41G 11/004* (2013.01)

(58) Field of Classification Search
CPC ..... F41G 11/002; F47G 11/003
USPC ..... 42/1.06, 124, 127, 90
See application file for complete search history.

(56) References Cited

U.S. PATENT DOCUMENTS 9,354,022 B2 * 5/2016 Eriksson ..... F41G 1/30
2014/0059908 A1 3/2014 Dextraze et al.

FOREIGN PATENT DOCUMENTS

EP 0601824 A1 6/1994
WO 2011/075026 A1 6/2011

OTHER PUBLICATIONS

International Search Report pertaining to PCT/ES2014/070698 with a filing date of Sep. 12, 2014 (4 pages).
Written Opinion pertaining to PCT/ES2014/070698 with a filing date of Sep. 12, 2014 (5 pages).

* cited by examiner

*Primary Examiner* — Reginald Tillman, Jr.
(74) *Attorney, Agent, or Firm* — Dinsmore & Shohl LLP

(57) ABSTRACT

Accessory for the installation, positioning and fixing of a telescopic sight or any other aiming accessory on an air rifle or firearm. The referred rifle or firearm comprises a series of longitudinal grooves (11) on its upper part, facing said accessory (10) and characterized in that said accessory comprises: first longitudinal support (14), with at least one orifice (17) perpendicular to the air rifle (12) or firearm, through which positioning means (16) pass that are housed on the rifle (12) or firearm, defining a firm supporting position between chamber (26) of said firearm and said first longitudinal support (14).

15 Claims, 8 Drawing Sheets

ACCESSORY FOR INSTALLING, POSITIONING AND ATTACHING A TELESCOPIC SIGHT OR ANY OTHER AIMING ACCESSORY ON A SPORTING GUN OR FIREARM

Accessory for installing, positioning and attaching a telescopic sight or any other aiming accessory on a sporting gun or firearm, said gun or firearm comprising on the upper portion thereof a series of longitudinal grooves facing said accessory, wherein said accessory comprises a first longitudinal support with at least one hole perpendicular to the gun or firearm, through which positioning means pass which are housed in the gun or firearm, defining a rigidly connected position between the chamber and said first support, and in that it comprises at least a second longitudinal support situated after the first and connected to said first support by at least one set of damping means, arranged between both longitudinal supports and attached to said supports, said second longitudinal support comprising means for the attaching of a telescopic sight or any other aiming accessory on the upper portion thereof, longitudinal guides on the lower portion thereof, at least partly attached to the gun and suitable for fitting in the grooves of said sporting gun or firearm, and a plurality of through-holes which pass from one side to the other of the accessory perpendicular to the longitudinal axis thereof and for the housing of attachment means, such that when inserted in the through-holes, the attachment means compress the accessory about the longitudinal axis thereof, applying pressure on the guides against the grooves of the gun like a clamp, attaching and immobilising the accessory in position on the gun or firearm.

PRIOR ART

Various telescopic sights or other aiming accessories are known in the prior art which are fitted to guns or rifles.

U.S. Pat. No. 5,531,039 'Base for mounting a telescopic sight on a gun', dated 1995, in the name of Thomas D Gore is known, which relates to a base which has two projecting wings, which rock like a seesaw when the gun is fired, in reaction to the high-frequency impact.

Also known is U.S. Pat. No. 4,026,055 'Telescopic sight mounting', dated 1976, in the name of Gerald T Weast, which relates to an attaching device for sights consisting of a pair of fixing elements, which comprise means for attaching to the rifle and other means for clamping the sight. These are two separate elements which can therefore be installed on the rifle independently.

The applicant is the owner of European Patent no. 1983291 'Accessory for installing, positioning and attaching a telescopic sight on a sporting rifle', dated 2006, which relates to an accessory for installing, positioning and attaching a telescopic sight on a sporting gun. It is made up of a longitudinal support, with means for attaching a telescopic sight on the upper portion thereof, said rifle also comprising a series of longitudinal grooves, facing said accessory which is characterised in that said accessory incorporates longitudinal guides, on the lower portion thereof, suitable for fitting in the grooves of said sporting gun.

BRIEF DESCRIPTION OF THE INVENTION

The present application forms part of the sector of systems for attaching telescopic sights or other aiming accessories to guns, pistols or rifles.

The closest document is European Patent no. 1983291. This document overcomes the problems of the prior art. Thus, with respect to the U.S. Pat. No. 4,026,055, a structure is produced which, once configured, becomes a single part, with no need to adjust the situation with regard to the telescopic sight.

Regarding U.S. Pat. No. 5,531,039, cited earlier as the closest document, there is no seesaw-type movement to absorb the impact, which may ultimately lead to poor adjustment of the telescopic sight.

The inventor has developed a novel accessory or support which is an improvement on the closest document.

Thus, it has been observed that with the above-mentioned supports the optics of the telescopic sight may eventually be damaged, and breaks may occur therein, as well as poor adjustment owing to the high-frequency energy spikes that are produced on firing.

When fired, the entire rifle wants to move backwards towards the shoulder of the shooter due to the forward propulsion of the piston. At the moment when the piston impacts against the chamber, this backwards inertia is instantly stopped by said impact and therefore the movement of the firearm, gun or rifle which was travelling rearwards is suddenly interrupted. As the sight is rigidly connected to the first support of the accessory (which is rigid) and the accessory in turn is connected to the chamber, said sight also suffers said sharp deceleration and therefore has a backwards movement relative to the chamber.

The chamber is suddenly slowed down and the sight, which is attached thereto by the accessory, wants to continue owing to the inertia. It is this impact that leads to defects in the attaching of sights and in the sights themselves (breakage of reticles and crosspieces).

Moreover, with time the hole for the screw which attaches the support to the sporting gun or firearm develops free movement, in other words, the screw comes loose and ceases to position the telescopic sight or aiming accessory.

With this novel multi-connector, the subject matter of the present invention, the connection between the chamber and the sight is made 'slightly' resilient and prevents a high-frequency impact from occurring. It is 'slightly' resilient because on the one hand it is resilient owing to the existence of resilient means, but on the other hand it is rigid because the sight is an aiming element and cannot move. Thus, with said resilient means, the high-frequency energy spikes are eliminated.

Similarly, as said high-frequency energy spike does not exist, the possible mechanical damage caused by repeated impact is considerably reduced, and the telescopic sight or other aiming accessory therefore remains unchanged for longer.

An object of the present invention is an accessory for installing, positioning and attaching a telescopic sight or any other aiming accessory on a sporting gun or firearm, said gun or firearm comprising on the upper portion thereof a series of longitudinal grooves facing said accessory, wherein said accessory comprises a first longitudinal support with at least one hole perpendicular to the gun or firearm, through which positioning means pass which are housed in the gun or firearm, defining a rigidly connected position between the chamber and said first support, and in that it comprises at least a second longitudinal support situated after the first and connected to said first support by at least one set of damping means arranged between both longitudinal supports and attached to said supports, said second longitudinal support comprising means for attaching a telescopic sight or other aiming accessory on the upper portion thereof, longitudinal guides on the lower portion thereof, at least partly attached to the gun and suitable for fitting in the grooves of said sporting gun or firearm, and a plurality of through-holes which pass from one side to the other of the accessory perpendicular to the longitudinal axis thereof and for the housing of attachment means such that when the attachment means are inserted in the through-holes they compress the accessory about the longitudinal axis thereof, applying pressure on the guides against the grooves of the gun like a clamp, attaching and immobilising the accessory in its position on the gun or firearm.

BRIEF DESCRIPTION OF THE DRAWINGS

For easier explanation, the eight drawings which accompany the present description show a practical embodiment, which is given as a non-limiting example of the scope of the present invention.

PRACTICAL EMBODIMENT OF THE PRESENT INVENTION

First of all, when the expression 'sporting gun' is mentioned, it means what in English is named as an air rifle or gas rifle, depending on the projectile or pellet supply system.

Similarly, in this embodiment the expressions sight or telescopic sight are used as equivalents, even when the reference may relate to any other aiming accessory.

Figure 1:
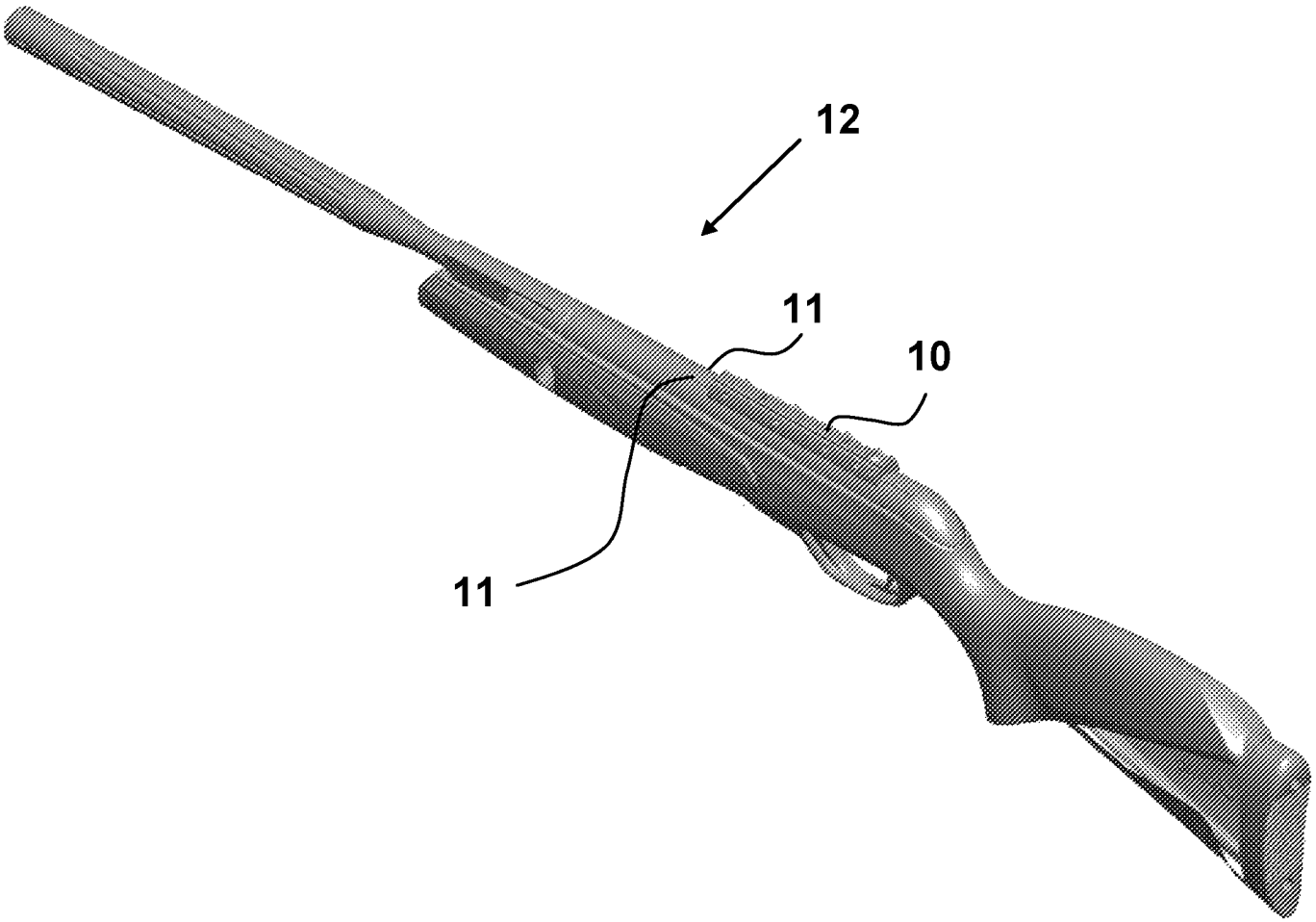
FIG. 1 is a perspective view of the accessory fitted to a sporting gun.

Thus, in FIG. 1 a sporting gun 12 is shown with longitudinal grooves 11 and an accessory 10.

Figure 2:
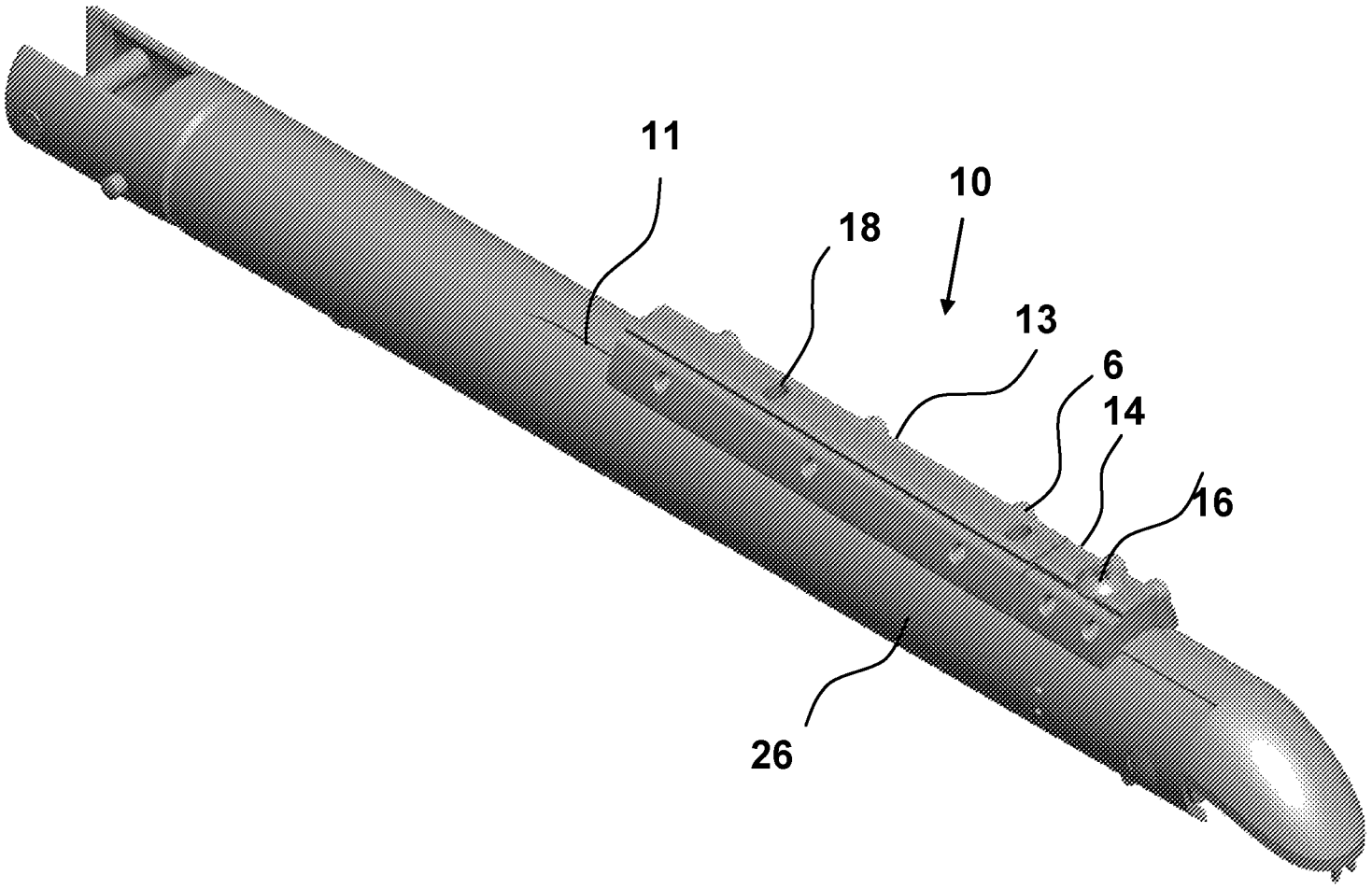
FIG. 2 is a view in part of the gun with the accessory.

FIG. 2 shows the accessory 10, the longitudinal grooves 11, a first longitudinal support 14, a second longitudinal support 13, centring attachment means 16, attaching holes 18 for a sight, a chamber 26 and attachment means 6.

Figure 3:
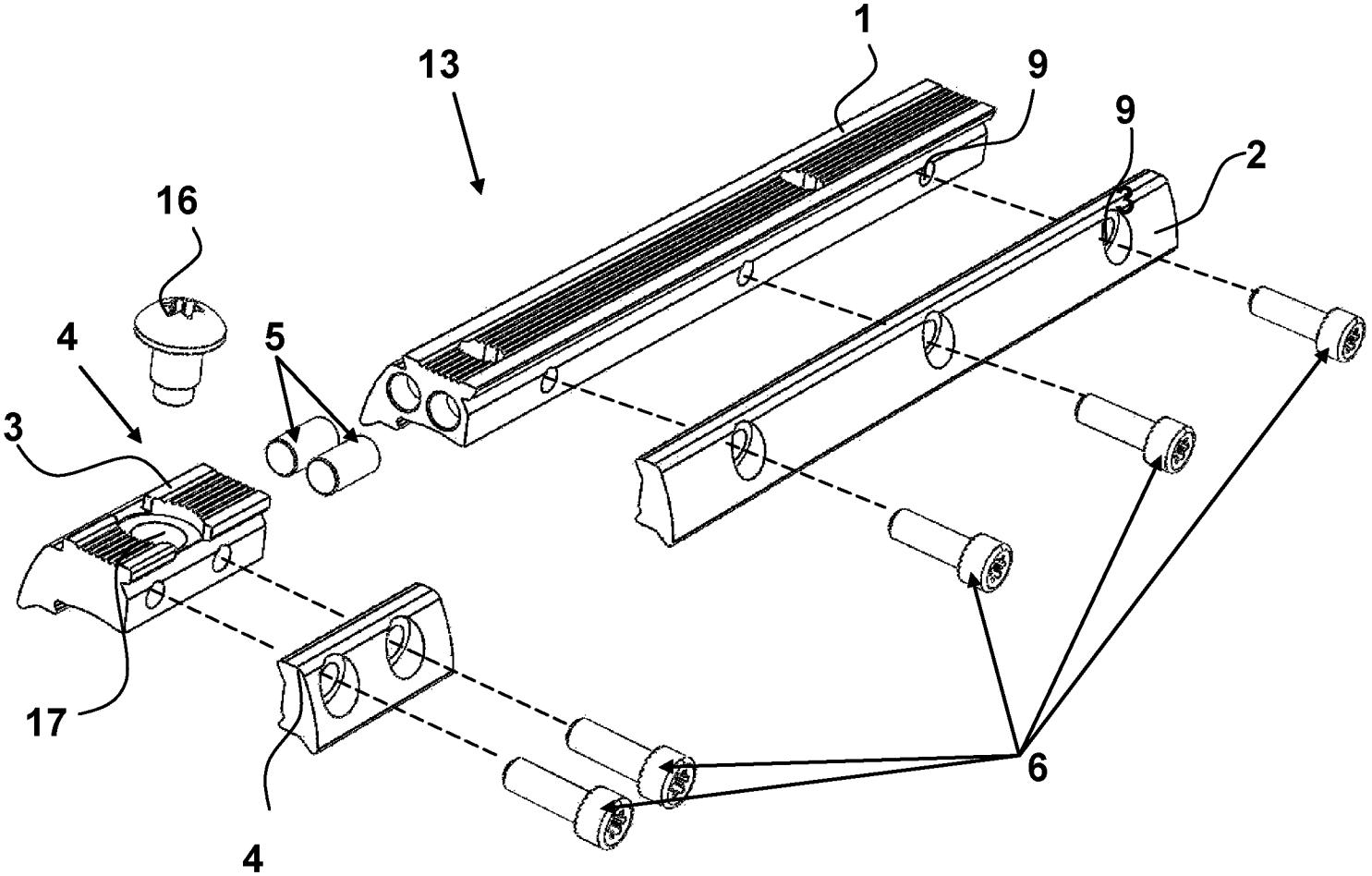
FIG. 3 is an exploded view of an accessory of a first embodiment.

FIG. 3 shows a large asymmetric part 3 and a small asymmetric part 4 belonging to the first longitudinal support 14, a large asymmetric part 1 and a small asymmetric part 2 belonging to the second longitudinal support 13, damping means 5, through-holes 9 with attachment means 6, centring attachment means 16 and a centring hole 17.

Figure 4:
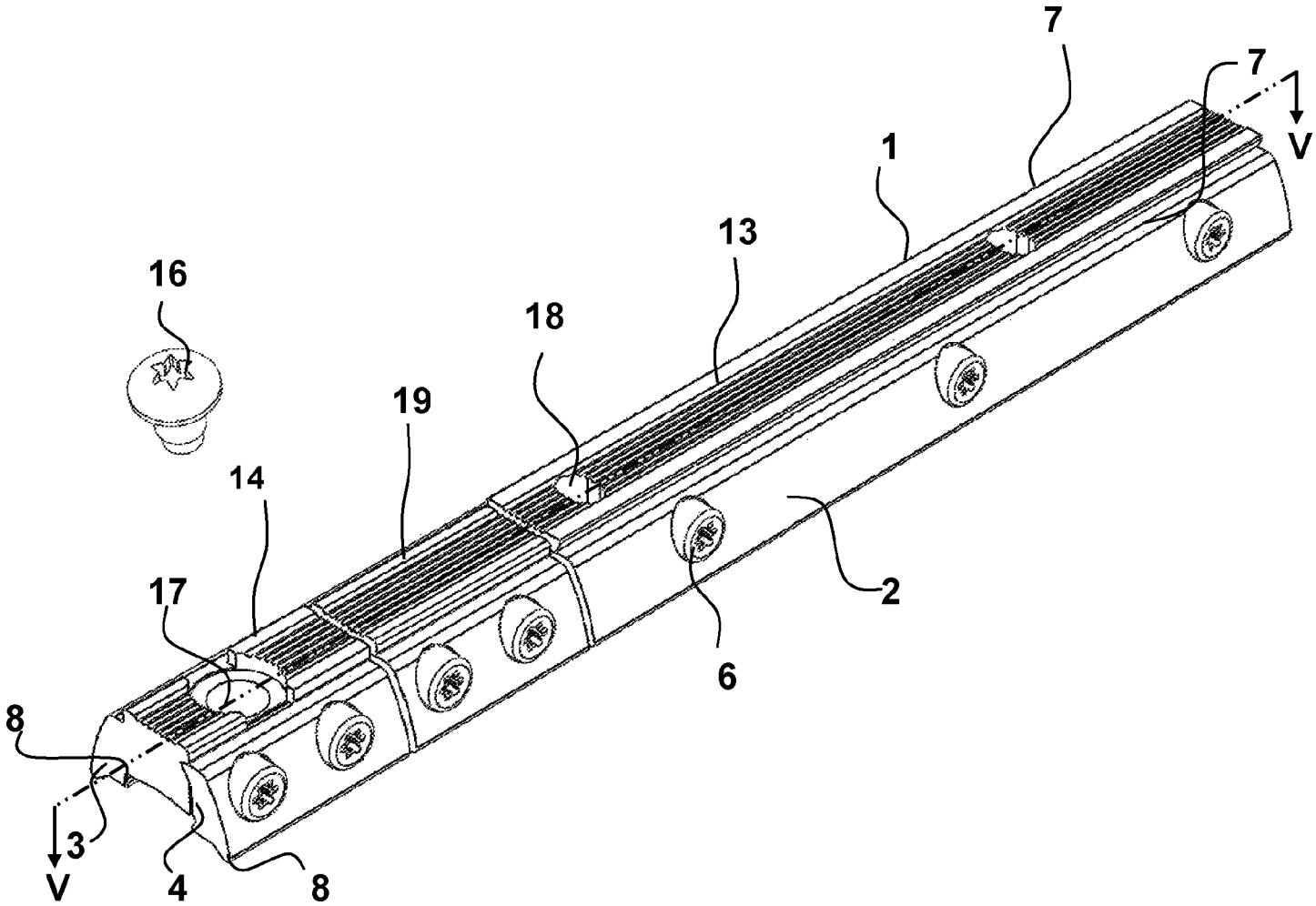
FIG. 4 is a perspective view of an accessory in a second embodiment with three longitudinal supports and FIG. 5 is a cross section along the line V-V of FIG. 4.

FIG. 4 illustrates the large asymmetric part 3 and the small asymmetric part 4 belonging to the first longitudinal support 14, the large asymmetric part 1 and the small asymmetric part 2 belonging to the second longitudinal support 13, the attachment means 6, the centring hole 17, the holes for positioning 18 the sight, means for attaching 7 the sight or telescopic sight, longitudinal guides 8, and a third longitudinal support 19.

Figure 5:
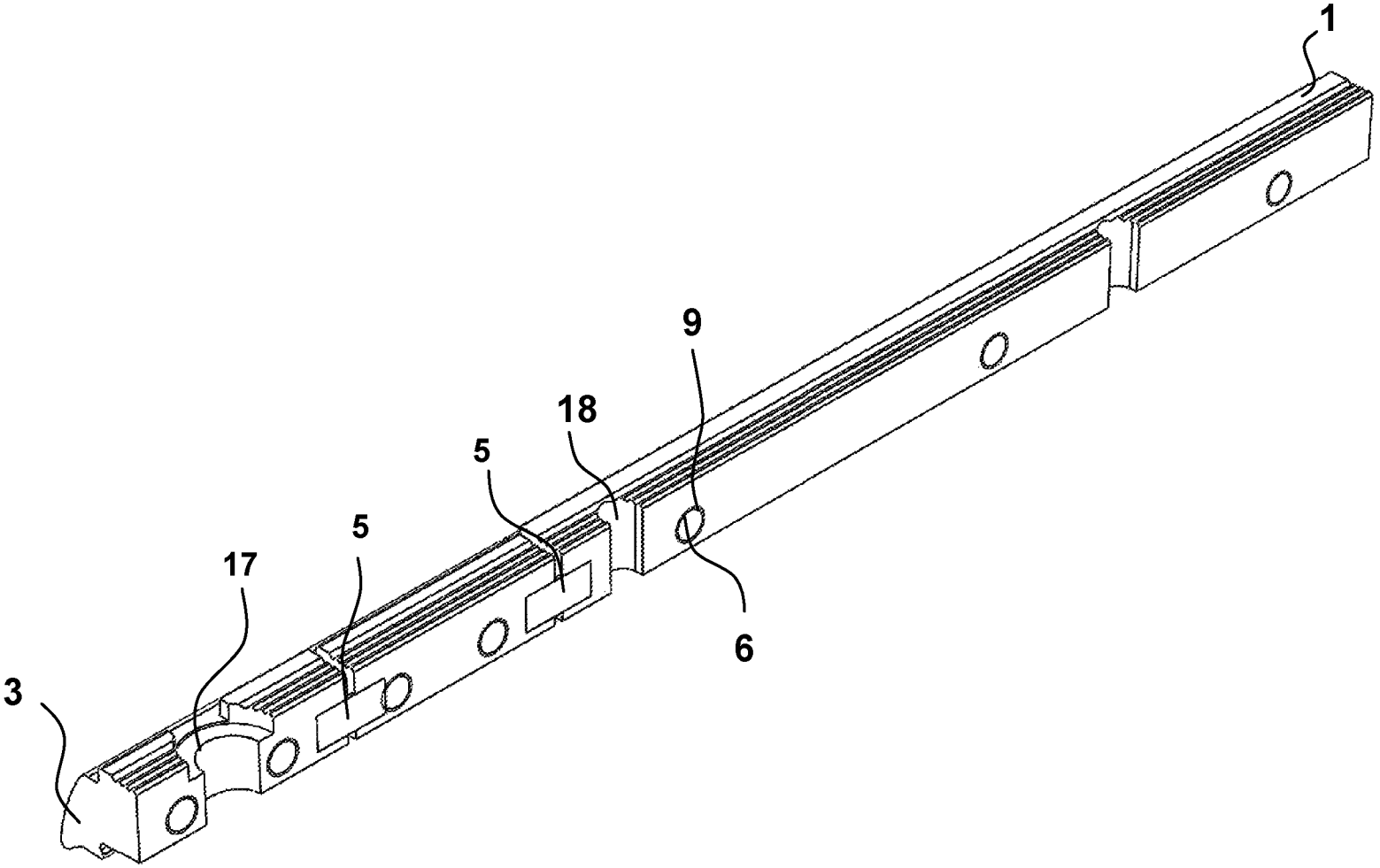

FIG. 5 shows the large asymmetric parts 1,3, the attachment means 6, the means for attaching 7 a telescopic sight, the centring hole 17 and the holes for positioning 18 the sight.

Figure 6:
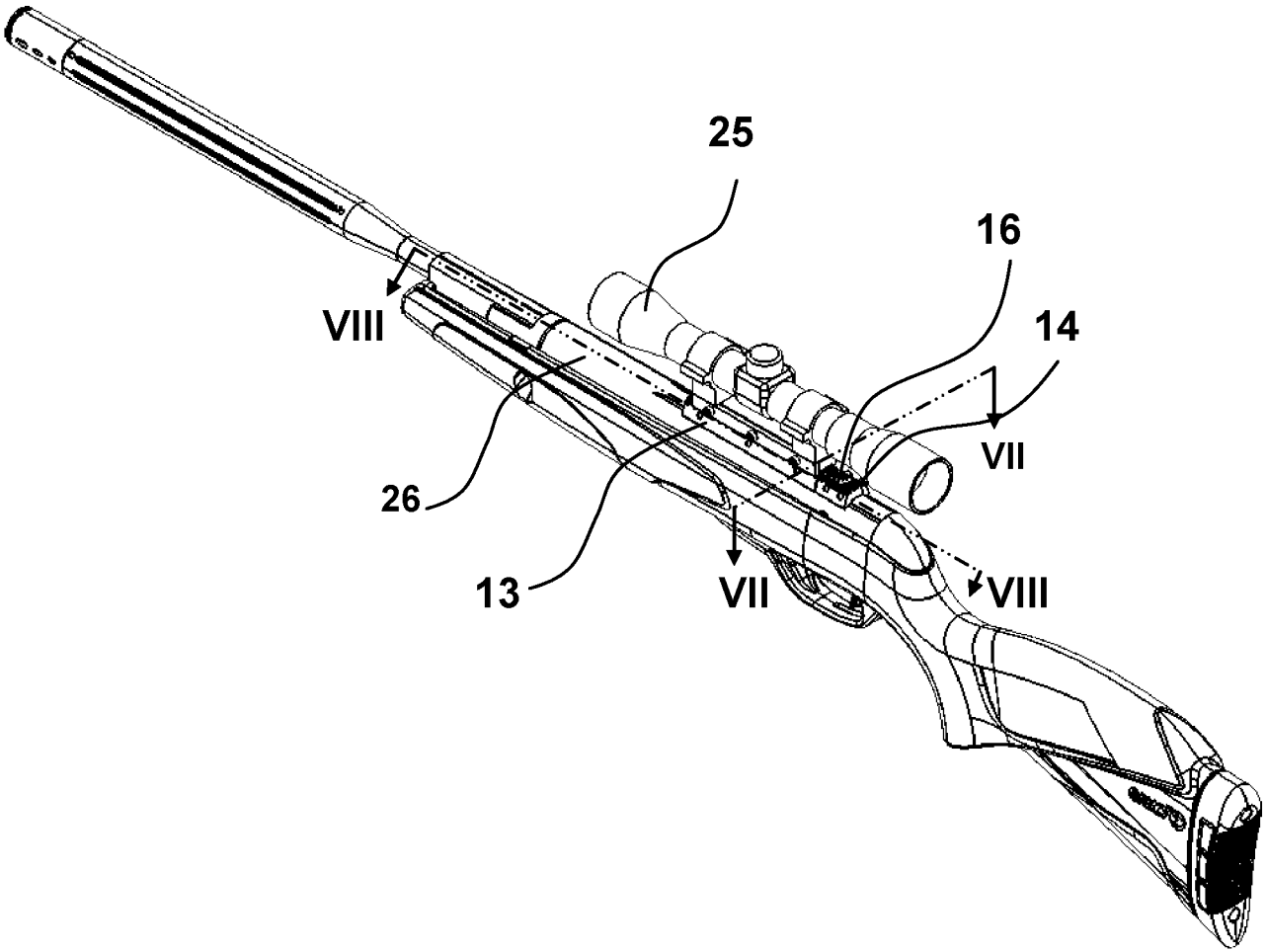
FIG. 6 is a general view of a gun with the accessory according to the first embodiment.

FIG. 6 shows the first longitudinal support 14, the second longitudinal support 13, a telescopic sight 25, the chamber 26 and the centring attachment means 16.

Figure 7:
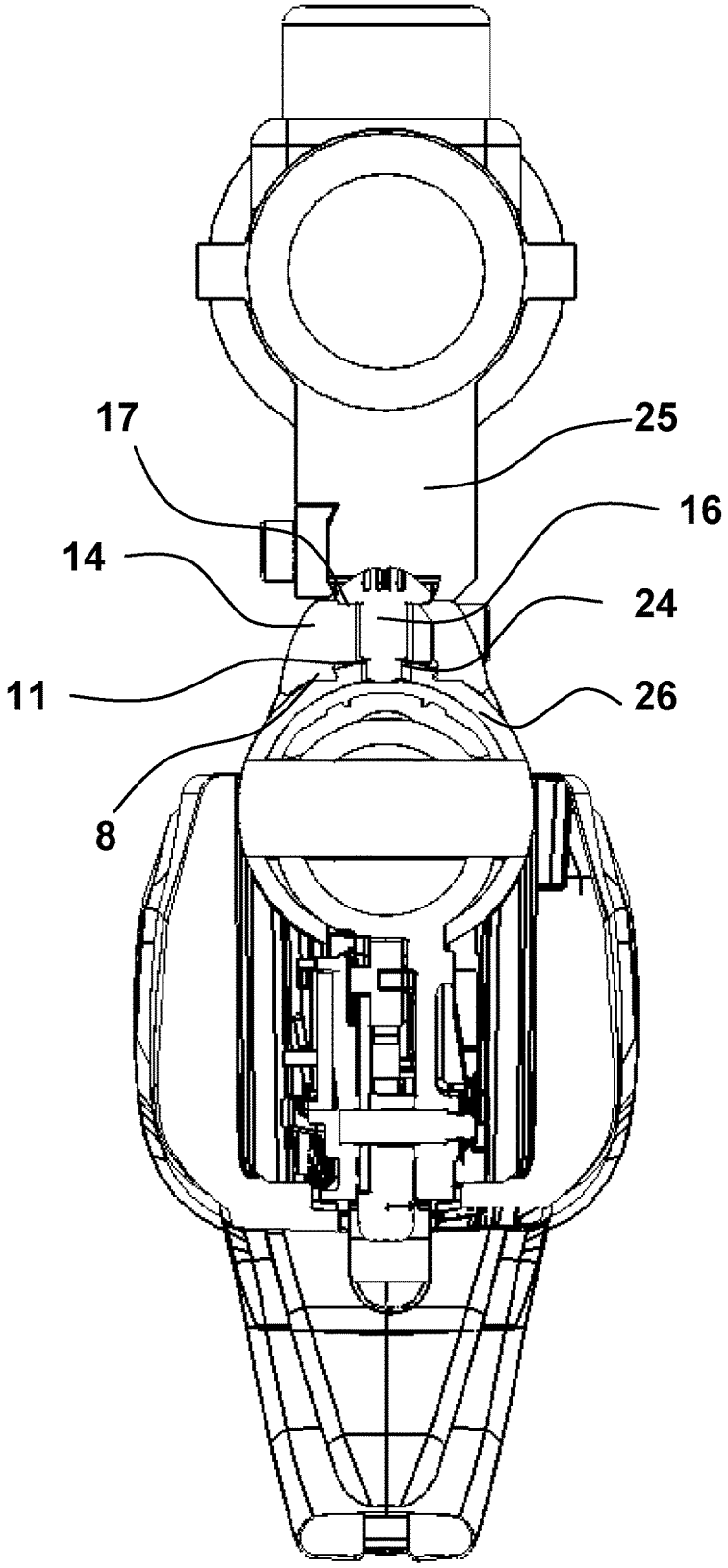
FIG. 7 is a cross section along the line VII-VII of FIG. 6.

FIG. 7 shows the first longitudinal support 14, the telescopic sight 25, the chamber 26, centring holes 17,24, the longitudinal guides 8, the longitudinal grooves 11 and the centring attachment means 16.

Figure 8:
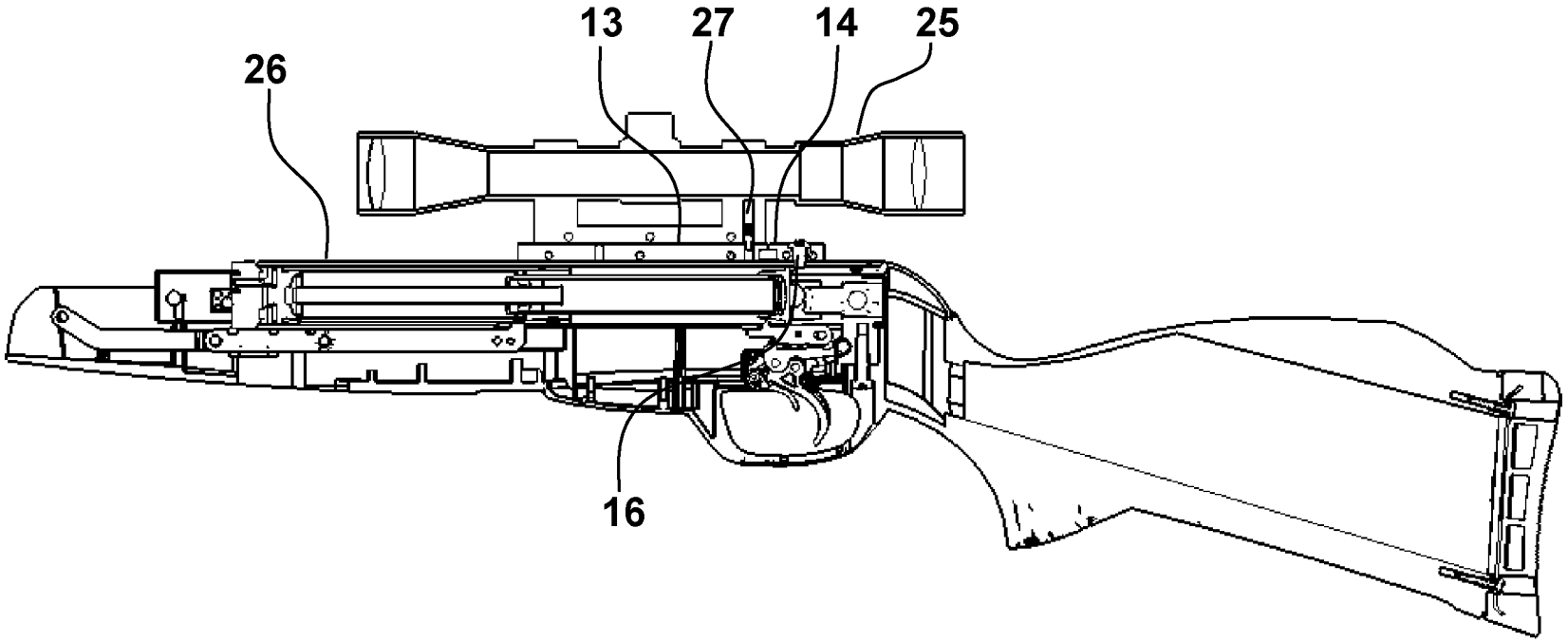
FIG. 8 is a cross section, without the barrel, along the line VIII-VIII of FIG. 6.

Finally, FIG. 8 shows the first longitudinal support 14, the second longitudinal support 13, the telescopic sight 25, means for attaching 27 the telescopic sight, the chamber 26 and the centring attachment means 16.

Thus, in a first embodiment (FIG. 3), the damping means 5 would be arranged between the first longitudinal support 14 and the second longitudinal support 13. In a second embodiment, the damping means 5 would be arranged between the first longitudinal support 14 and the third longitudinal support 19 and between the third longitudinal support 19 and the second longitudinal support 13 (FIG. 5).

Next, said accessory 10 is installed on the sporting gun 12 in the following manner.

The longitudinal guides 8 are passed along the longitudinal grooves 11 until the centring hole 17 faces a centring hole 24 (FIG. 7) in said chamber 26 of the sporting gun 12.

Next, the second longitudinal support 13 is attached to the gun 12 using centring attachment means 16, for example a screw, through said holes 17 and 24.

Then the attachment means 6 are secured, through the through-holes 9, in such a way that the longitudinal guides 8 catch the longitudinal grooves 11 and the accessory 10 is completely immobilised, the longitudinal grooves 11 therefore facing the longitudinal guides 8 (FIG. 7). The attachment means 6, in this embodiment screws (although they could be other attachment means such as pins, etc.), therefore compress the accessory about its longitudinal axis, applying pressure on the guides 8 against the grooves 11 of the gun like a clamp, attaching and immobilising the accessory 10 in position on the gun 12 or firearm.

In this embodiment, the second longitudinal support 13 is the only one that has means for attaching 7 a telescopic sight on the upper portion thereof.

The second longitudinal support 13, which is situated directly (FIGS. 1 to 3) or indirectly (FIGS. 4 and 5) after the first longitudinal support 14, is connected to the first support 14 by at least one set of damping means 5, which in this embodiment are two cylinders, arranged between both longitudinal supports 13,14 and attached to said supports 13,14.

The damping means 5 are made of a polymer, for example a polyamide, which gives a small amount of resilience to the assembly, while at the same time maintaining rigidity, as explained earlier.

The cylinders 5 are situated partly on each of the supports 13,14, leaving a predetermined distance which separates both supports and which will serve to damp the impact.

This embodiment has been produced so that each one of the supports 13,14 is manufactured in two longitudinal parts 1,2 and 3,4, which are connected to each other by said attachment means 6. In this case both supports are attached, and this structure therefore makes the work of assembly and disassembly easier, allowing better attachment of the accessory 10 to the gun 12.

In this embodiment, the parts 1,2,3,4 are longitudinally asymmetric. This means that the entire structure can be maintained attached in the same part 1,3, in other words, the cylinders 5 are fitted together in the larger asymmetric parts 1,3 and the means for attaching 7 a telescopic sight are situated in the larger asymmetric part 1 of the second longitudinal support 13, and damping therefore works much better.

The means for attaching 7 a telescopic sight are in the form of a dovetail in this embodiment (although they could take another form, such as a Picatinny rail, etc.) and are situated along the larger asymmetric part 1 of the second longitudinal support 13. The first longitudinal support 14 should not have elements for attaching 7 to the telescopic sight 25. This is to ensure that the telescopic sight 25 cannot be partly attached to the first longitudinal support 14, and therefore ensures that the damping is not negated.

As shown in FIGS. 4 and 5, a third longitudinal support 19 may be provided, situated between the first longitudinal support 14 and the second longitudinal support 13, connected to the respective supports 13,14 by the corresponding damping means 5. Said third longitudinal support 19, like the first longitudinal support 14, would not have attachment means 7 for the telescopic sight, to ensure that the damping is not negated.

As explained earlier, when the gun 12 is fired, due to the forward propulsion of the piston (not illustrated), the chamber 26 and in turn the gun 12, have a tendency to move backwards, towards the shoulder of the shooter. As disclosed earlier, the sight 25 is rigidly connected to the second longitudinal support 13 and, in turn, said longitudinal support 13 is rigidly connected to the first longitudinal support 14. Due to the first longitudinal support 14 is connected to the chamber 26, both supports 13,14 and the sight 25 also have a tendency to move backwards.

When the piston impacts against the chamber 26 a high frequency impact is produced. Due to this impact, the backwards movement of the chamber 26, and therefore the gun 12, supports 13,14 and sight 25 is suddenly interrupted.

The polyamide cylinders 5 are responsible for absorbing the high-frequency impact produced.

It is this combination of slight or low resilience conferred by the cylinders 5, due to the rigidity of the accessory 10, which means that although the sight 25 does not move, at the same time said sight does not receive the impact or spikes of high-frequency energy which are absorbed by the cylinders 5.

Similarly, as there is no spike of high-frequency energy, scarcely any loosening or wear occurs to the parts, either to the sight 25 or to the attaching thereof, and the telescopic sight 25 therefore remains unchanged for longer.

In this embodiment, the example of a sporting gun has been given, although it is equally possible to consider its use in a sporting pistol or firearm.

The present invention describes a novel accessory for installing, positioning and attaching a telescopic sight or any other aiming accessory on a sporting gun or firearm. The examples mentioned here do not limit the present invention, which could therefore have other applications and/or adaptations, all within the scope of the following claims.

The invention claimed is:

1. An accessory for installing, positioning, and attaching a telescopic sight or any other aiming accessory on a sporting gun or firearm, said sporting gun or firearm comprising on an upper portion thereof a series of longitudinal grooves facing said accessory, the accessory comprising:

a first longitudinal support with at least one hole perpendicular to the sporting gun or firearm, a positioning means passing through the at least one hole of the first longitudinal support, the positioning means being housed in the sporting gun or firearm, defining a rigidly connected position between a chamber of the sporting gun or firearm and said first support, a second longitudinal support situated after the first longitudinal support and connected to said first longitudinal support by at least one set of damping means arranged between both longitudinal supports and attached to said supports, said second longitudinal support comprising:

means for attaching a telescopic sight or any other aiming accessory on a upper portion of the second longitudinal support, longitudinal guides on a lower portion of the second longitudinal support, at least partly attached to the sporting gun or firearm and suitable for fitting in grooves of said sporting gun or firearm, and a plurality of through-holes the pass from one side to the other of the accessory perpendicular to a longitudinal axis or the accessory and for the housing of attachment means, such that when the attachment means is inserted in the through-holes, the attachment means compress the accessory about the longitudinal axis, applying pressure on the guides against the grooves of the gun like a clamp, attaching and immobilizing the accessory in position on the gun or firearm.

2. The accessory of claim 1, wherein the damping means are made of a polymer.

3. The accessory of claim 2, wherein said damping means are at least one cylinder that enters partly into each of the longitudinal supports and separates the longitudinal supports by a predetermined distance.

4. The accessory of claim 2, wherein said polymer is a polyamide.

5. The accessory of claim 4, wherein said damping means are at least one cylinder that enters partly into each of the longitudinal supports and separates the longitudinal supports by a predetermined distance.

6. The accessory of claim 1, wherein said damping means are at least one cylinder that enters partly into each of the longitudinal supports and separates the longitudinal supports by a predetermined distance.

7. The accessory of claim 6, wherein the two longitudinal parts are both longitudinally asymmetric and both comprise a larger asymmetric part.

8. The accessory of claim 7, wherein the at least one cylinder is situated between the larger asymmetric parts of the supports.

9. The accessory of claim 1, wherein at least one of the longitudinal supports is produced in two longitudinal parts connected to each other by said attachment means.

10. The accessory of claim 9, wherein the two longitudinal parts are both longitudinally asymmetric and both comprise a larger asymmetric part.

11. The accessory of claim 10, wherein the at least one cylinder is situated between the larger asymmetric parts of the longitudinal supports.

12. The accessory of claim 11, wherein the means for attaching a telescopic sight are situated in the larger asymmetric part of the second longitudinal support.

13. The accessory of claim 12, wherein the means for attaching a telescopic sight are in the form of a dovetail and are situated along the larger asymmetric part of the second longitudinal support.

14. The accessory of claim 13, further comprising a third longitudinal support situated between the first longitudinal support and the second longitudinal support, connected to the respective supports by the corresponding damping means.

15. The accessory of claim 1, further comprising a third longitudinal support situated between the first longitudinal support and the second longitudinal support, connected to the respective supports by the corresponding damping means.

* * * * *